US009816776B2

(12) United States Patent
Ellig et al.

(10) Patent No.: US 9,816,776 B2
(45) Date of Patent: Nov. 14, 2017

(54) FALL AWAY ARROW REST SYSTEM

(71) Applicants: Michael J. Ellig, Bozeman, MT (US); Phillip Larson, Bozeman, MT (US)

(72) Inventors: Michael J. Ellig, Bozeman, MT (US); Phillip Larson, Bozeman, MT (US)

(73) Assignee: BLACK GOLD ARCHERY, LLC, Belgrade, MT (US)

( * ) Notice: Subject to any disclaimer, the term of this patent is extended or adjusted under 35 U.S.C. 154(b) by 0 days.

(21) Appl. No.: 15/201,421

(22) Filed: Jul. 2, 2016

(65) Prior Publication Data

US 2017/0003096 A1 Jan. 5, 2017

Related U.S. Application Data

(60) Provisional application No. 62/188,241, filed on Jul. 2, 2015.

(51) Int. Cl.
*F41B 5/22* (2006.01)
*F41B 5/14* (2006.01)

(52) U.S. Cl.
CPC ..... *F41B 5/143* (2013.01)

(58) Field of Classification Search
CPC ..... F41B 5/143
USPC ..... 124/44.5, 86, 88
See application file for complete search history.

(56) References Cited

U.S. PATENT DOCUMENTS 4,865,007 A * 9/1989 Saunders ..... F41B 5/143 124/24.1
6,044,832 A * 4/2000 Piersons, Jr. ..... F41B 5/143 124/44.5
6,178,959 B1 * 1/2001 Troncoso, Jr. ..... F41B 5/143 124/44.5
6,595,195 B1 * 7/2003 Barner ..... F41B 5/143 124/44.5
6,615,813 B1 * 9/2003 Troncoso, Jr. ..... F41B 5/143 124/44.5
6,634,349 B2 * 10/2003 Mizek ..... F41B 5/143 124/44.5
6,684,871 B1 * 2/2004 Troncoso ..... F41B 5/143 124/44.5
6,789,536 B1 * 9/2004 Summers ..... F41B 5/143 124/44.5
7,331,338 B2 * 2/2008 Mizek ..... F41B 5/143 124/44.5
7,409,950 B2 8/2008 Ellig et al.
(Continued)

*Primary Examiner* — Alexander Niconovich
(74) *Attorney, Agent, or Firm* — Husch Blackwell LLP

(57) ABSTRACT

An arrow rest device for bows and similar equipment is provided. The arrow rest can include a y-shaped launcher, a shaft and a housing with an activator. The launcher and the activator can be fixedly connected to the shaft and rotate therewith. Within the housing can be a wall with an obstruction that can be shaped and designed to interact with a ball detent or similar component located on the end of the activator. The activator can be configured to rotate inside the housing wall and can be coupled to the housing with a biasing element that urges rotation of the activator and shaft in one direction. The activator can rotate in the housing between three positions, each corresponding to an orientation of the launcher. In one position, the activator is maintained by the wall so as to allow the launcher to have an upright orientation for supporting an arrow.

13 Claims, 11 Drawing Sheets

(56) References Cited

U.S. PATENT DOCUMENTS

| | | | | |
|---|---|---|---|---|
| 7,597,095 | B2 * | 10/2009 | Grace, Jr. | F41B 5/143 124/44.5 |
| 7,963,279 | B2 * | 6/2011 | Harwath | F41B 5/143 124/24.1 |
| 7,980,237 | B1 * | 7/2011 | Rasor | F41B 5/143 124/44.5 |
| 8,434,464 | B1 * | 5/2013 | Terzo | F41B 5/143 124/44.5 |
| 8,474,443 | B2 * | 7/2013 | Geno | F41B 5/143 124/44.5 |
| 8,544,457 | B1 * | 10/2013 | Munsell | F41B 5/143 124/44.5 |
| 8,596,253 | B2 * | 12/2013 | Adams | F41B 5/143 124/44.5 |
| 8,701,643 | B2 | 4/2014 | Ellig | |
| 8,752,536 | B2 * | 6/2014 | Sims | F41B 5/10 124/24.1 |
| 8,960,174 | B2 * | 2/2015 | Khoshnood | F41B 5/143 124/44.5 |
| 9,151,567 | B1 * | 10/2015 | Estridge | F41B 5/143 |
| 9,341,433 | B1 * | 5/2016 | Summers | F41B 5/143 |
| 2006/0157038 | A1 * | 7/2006 | Ellig | F41B 5/143 124/44.5 |
| 2008/0216807 | A1 * | 9/2008 | Troncoso | F41B 5/143 124/88 |
| 2009/0101127 | A1 * | 4/2009 | Johnson | F41B 5/143 124/25.6 |
| 2011/0139137 | A1 * | 6/2011 | Simo | F41B 5/0026 124/44.5 |
| 2012/0138035 | A1 * | 6/2012 | Ellig | F41B 5/1438 124/44.5 |

* cited by examiner

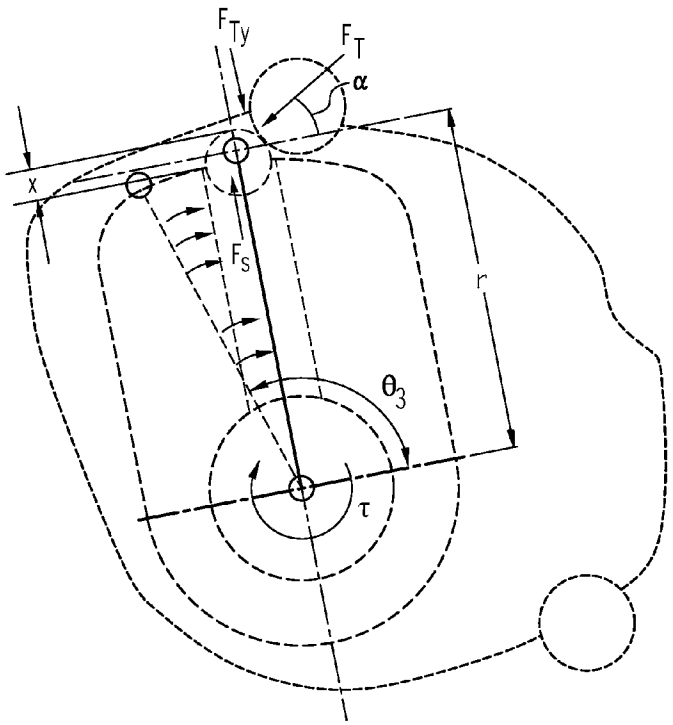

| | |
|---|---|
| $\tau = K_T \cdot \theta_3$ | $F_S = K_S \cdot X$ |
| $F_T = \tau / (r \cdot \sin\alpha) = K_T \cdot \theta_3 / (r \cdot \sin\alpha)$ | |
| $F_{Ty} = F_T \cdot \cos\alpha = K_T \cdot \theta_3 \cdot \cos\alpha / (r \cdot \sin\alpha)$ | |

FIG. 8B

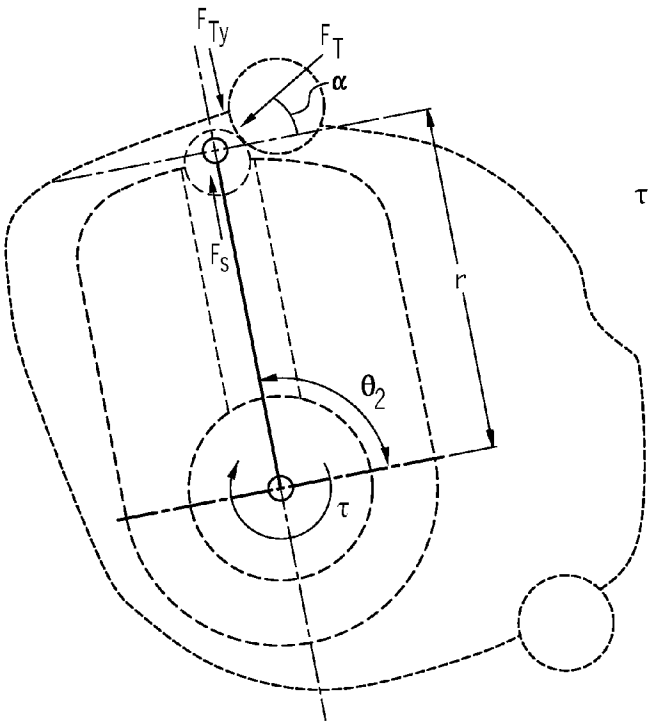

| | |
|---|---|
| $\tau = K_T \cdot \theta_2$ | $F_T = K_S \cdot X$ |
| $F_T = \tau / (r \cdot \sin\alpha) = K_T \cdot \theta_2 / (r \cdot \sin\alpha)$ | |
| $F_{Ty} = F_T \cdot \cos\alpha = K_T \cdot \theta_2 \cdot \cos\alpha / (r \cdot \sin\alpha)$ | |

FIG. 8A

FALL AWAY ARROW REST SYSTEM

CROSS-REFERENCE TO RELATED APPLICATIONS

This Application claims priority to U.S. Provisional Patent Application Ser. No. 62/188,241, filed on Jul. 2, 2015, to Michael J. Ellig, entitled "Fall Away Arrow Rest System," the entire disclosure of which is incorporated herein by reference.

BACKGROUND OF THE INVENTION

Arrow rests for compound bows enable a user to more easily and more accurately draw, aim, and fire an arrow at a directed target. The rest provides the user with a steady surface on which the user can place the shaft of the arrow while preparing to fire the bow so that the user need not be concerned about dropping the arrow. In addition, arrow rests enable the user to make aiming adjustments based on the surrounding environmental conditions (e.g., wind speed and direction) while reducing the tendency of dropping the arrow.

A common problem with traditional arrow rests is that the fletching of the arrow would contact the arrow rest as the arrow passed through the rest upon firing of the bow. This would result in a change of trajectory and flight path of the arrow, thereby reducing accuracy. Fall away arrow rests were then developed in order to reduce the likelihood of this problem. Fall away arrow rests, such as those described and shown in U.S. Pat. Nos. 6,789,536 and 8,701,643, include a launcher or support element that rotates down into a generally horizontal position once the arrow is fired such that the launcher or support element is completely out of the way and fletching contact is avoided. However, the designs for fall away arrow rests that are currently used in art contain inherent limitations. One common problem is that fall away arrow rests contain a complex and intricate construction of parts that can easily malfunction and are prone to failure, especially in rugged environments commonly encountered by bow hunters. Another common problem with currently used fall away arrow rests art is that they do not remain in an upright position when the string of a drawn bow is let down after the user decides not to fire. As a result, the arrow does not remain steadied such that the user may quickly redraw the bow and fire the arrow.

Accordingly, a need exists for a fall away arrow rest that contains a simple and durable construction and that is capable of remaining in the upright position when the string of a drawn bow is let down slowly so as to maintain the arrow in a steady position.

SUMMARY OF THE INVENTION

The present invention relates generally to a fall away arrow rest device for use with a bow. The arrow rest can include a y-shaped launcher fixedly mounted to a rotating shaft. The launcher can be configured to support an arrow a user is drawing and firing the bow. In addition, the launcher is configured to rotated down and out of the way of the arrow (when the arrow is fired) so that tail section and fletching of the fired arrow does not contact the launcher and and impact the arrows intended flight path.

The arrow rest and the launcher can be operated by an activator component also fixedly connected to the rotating shaft on the end of the shaft opposite the launcher. The activator component can be positioned within a housing that is attached to the bow in a manner that allows the shaft, the activator and the launcher to rotate relative to the housing. The shaft can also be coupled to the housing with a torsional biasing element (such as a spring) in a manner that urges rotation of the shaft. Within the housing can be a wall that is shaped and dimensioned to allow rotation of the activator component between three positions within the housing. Each position of the activator component corresponds to a position of the launcher. In the first position, the launcher is in a lowered configuration. In the second position, the launcher is in an upright arrow support configuration. In the third position, the launcher is in a tilted drawn arrow position. Due to the positioning of the torsional biasing element, as the activator component travels from the first position to the second position and then to the third position, the torque applied about the shaft (and therefore the activator component) increases.

The activator component can include a ball detent, depressible pin or similar structure that allows a portion of the top of the activator component to move underneath an obstruction defined into the wall of the housing. This obstruction can be selectively positioned so that the end of the activator component contacts the obstruction when the activator component is in the second position.

The torsional biasing element, ball detent and the wall obstruction can all be configured to operate the arrow rest. When the launcher is in its lowered position (and the activator component is in the first position), the launcher can be rotated upward toward the upright arrow support position. Upon reaching this position, the activator component is in the second position and can be configured to remain in the second position due to the wall obstruction preventing the ball detent from passing underneath. However, when the launcher is rotated further back into the drawn position, the activator component can also rotate further back into the third position. When the activator component is released from the third position, the torsional biasing element urges the activator component forward back toward the second position. Due to the rotational momentum of the activator upon reaching the second position, the ball detent depressed upon contact with the wall obstruction and the activator component is free to travel from the second position to the first position. During this rotation, the launcher can rotate from the drawn upright position to the upright arrow support position to the lowered position.

The foregoing sequence of positions can correspond to the firing of an arrow by a user of the bow. In order to facilitate the use of the arrow rest with the bow, the arrow rest can include a cord mount having a cord connected to the bow string of the bow. Thus, when the bow string is drawn and pulled back, the cord mount causes the shaft of the arrow rest to rotate, thereby causing rotation of the launcher and the activator component. When the user fully draws back the bow string, the launcher is in the drawn position and the activator component is in the third position. If the user decides to fire the arrow by releasing the string, the activator component rotates toward the second position where ball detent depresses underneath the wall obstruction allowing the activator component to continue rotation to the first position. During this time, the launcher rotates to its lowered position allowing the arrow to pass by the launcher without being obstructed. If however, the user decides not to fire the drawn arrow, the user can slowly let back the bow string. During this movement, the activator component rotates back toward the second position. However, the reduced angular momentum of the activator component prevents the ball detent from depressing and the wall obstruction prevents the activator component from rotating beyond the second position. Thus, the launcher remains in the upright arrow support position so that the arrow rest can continue supporting the unfired arrow.

Other aspects and advantages of the present invention will be apparent from the following detailed description of the preferred embodiments of the accompanying drawings figures.

DESCRIPTION OF THE SEVERAL VIEWS OF THE DRAWING

In the accompanying drawing, which forms a part of the specification and is to be read in conjunction therewith in which like reference numerals are used to indicate like or similar parts in the various views:

FIG. 8A is a diagrammatic right side view of a fall away arrow rest in accordance with one embodiment of the present invention illustrating the applied forces when the launcher is statically located in the upright position; and FIG. 8B is a diagrammatic right side of a fall away arrow rest in accordance with one embodiment of the present invention illustrating the applied forces when the launcher reaches the upright support position after being released from the drawn upright position.

DETAILED DESCRIPTION OF THE INVENTION

Figure 1:
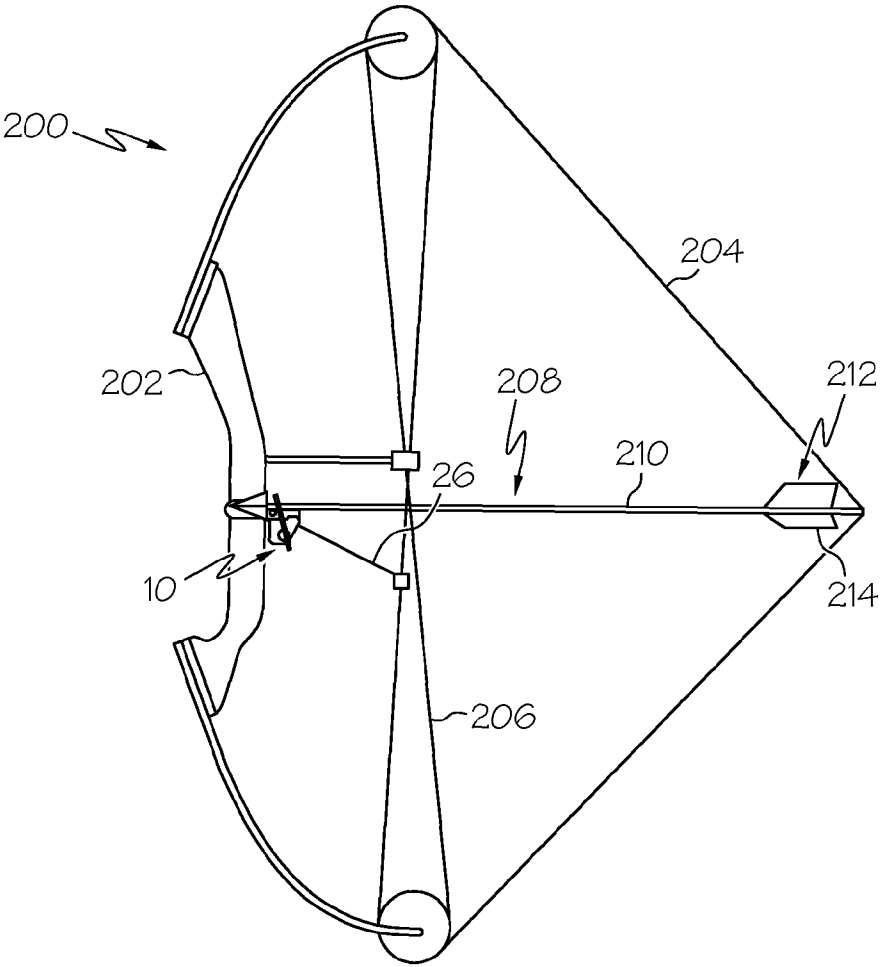
FIG. 1 is a left side view of a fall away arrow rest in use with a compound bow and arrow in accordance with one embodiment of the present invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

The present invention is directed generally to an improved fall away arrow rest device 10 as shown in various embodiments throughout the several figures. Arrow rest 10 of the present invention can be designed and configured to overcome several deficiencies of previously-known fall away arrow rest designs. As shown in FIG. 1, arrow rest 10 can be configured for use in connection with a compound bow 200; however, arrow rest 10 can also be just as suitably used with any type of bow or archery device or other similar equipment. For exemplary purposes, FIG. 1 illustrates compound bow 200 with a frame 202, a bow string 204 and a bow cable 206 and being used with an arrow 208. Bow 200 is also shown as being generally vertically orientated with arrow 208 extending generally longitudinally relative to bow 200. However, arrow 208 can just as suitably be fired from any number of directions or orientations depending upon the desired flight path of arrow 208.

As shown in FIG. 1, arrow 208 can include an arrow shaft 210, an arrow tail section 212 and an arrow fletching 214. Arrow rest 10 can be configured for affixture to bow 200 (such as on bow frame 202) in a manner that allows arrow shaft 210 to rest on arrow rest 10 when bow 200 is drawn using bow string 204. The "fall away" feature of arrow rest 10 can enable the avoidance of contact between arrow rest 10 and arrow fletching 214 when bow 200 is drawn and fired and arrow 208 passes by arrow rest 10 as described in greater detail below.

Figure 2:
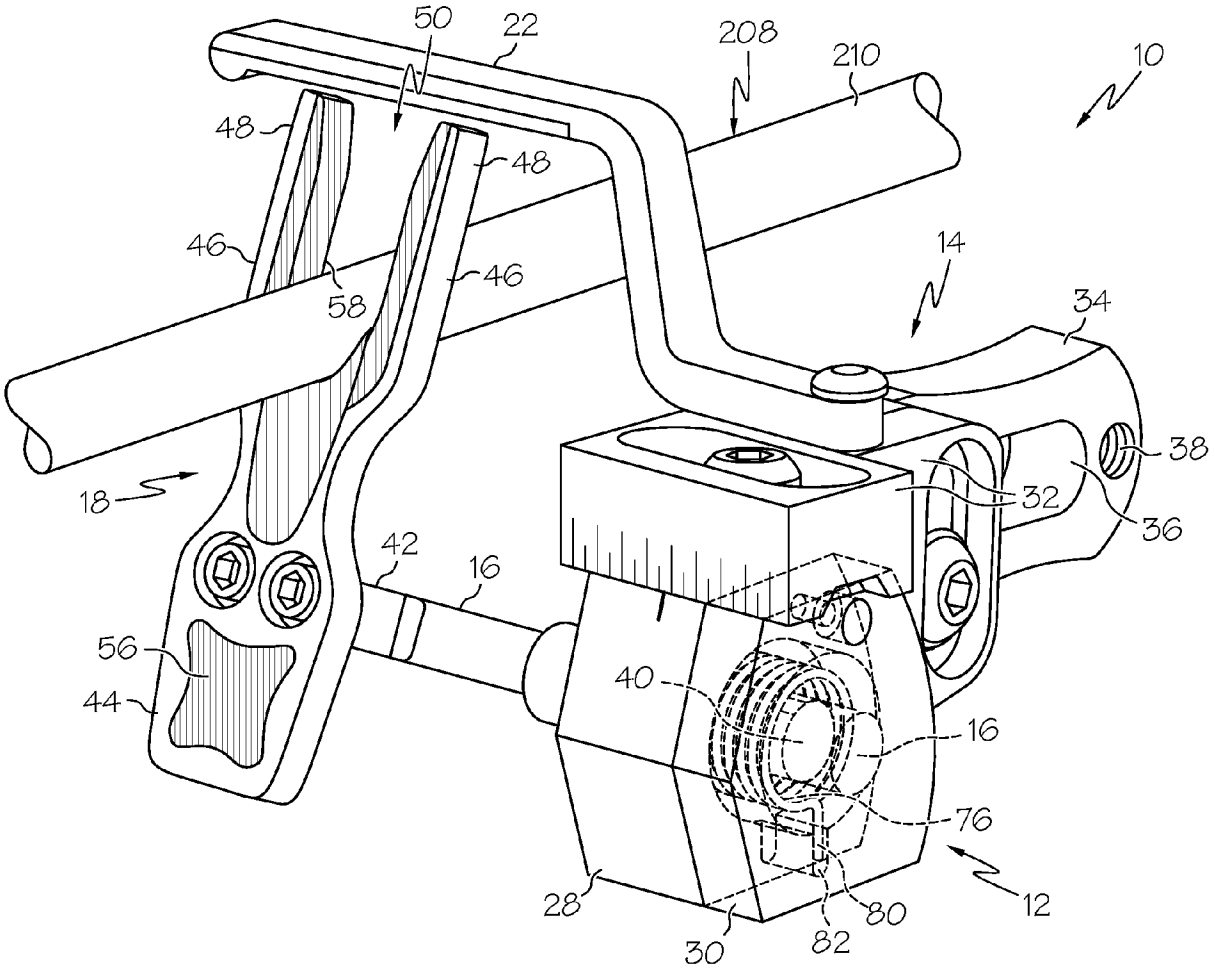
FIG. 2 is a perspective view of a fall away arrow rest in accordance with one embodiment of the present invention illustrating at least a portion of its internal components and showing the launcher in an upright support position.
Figure 3A:
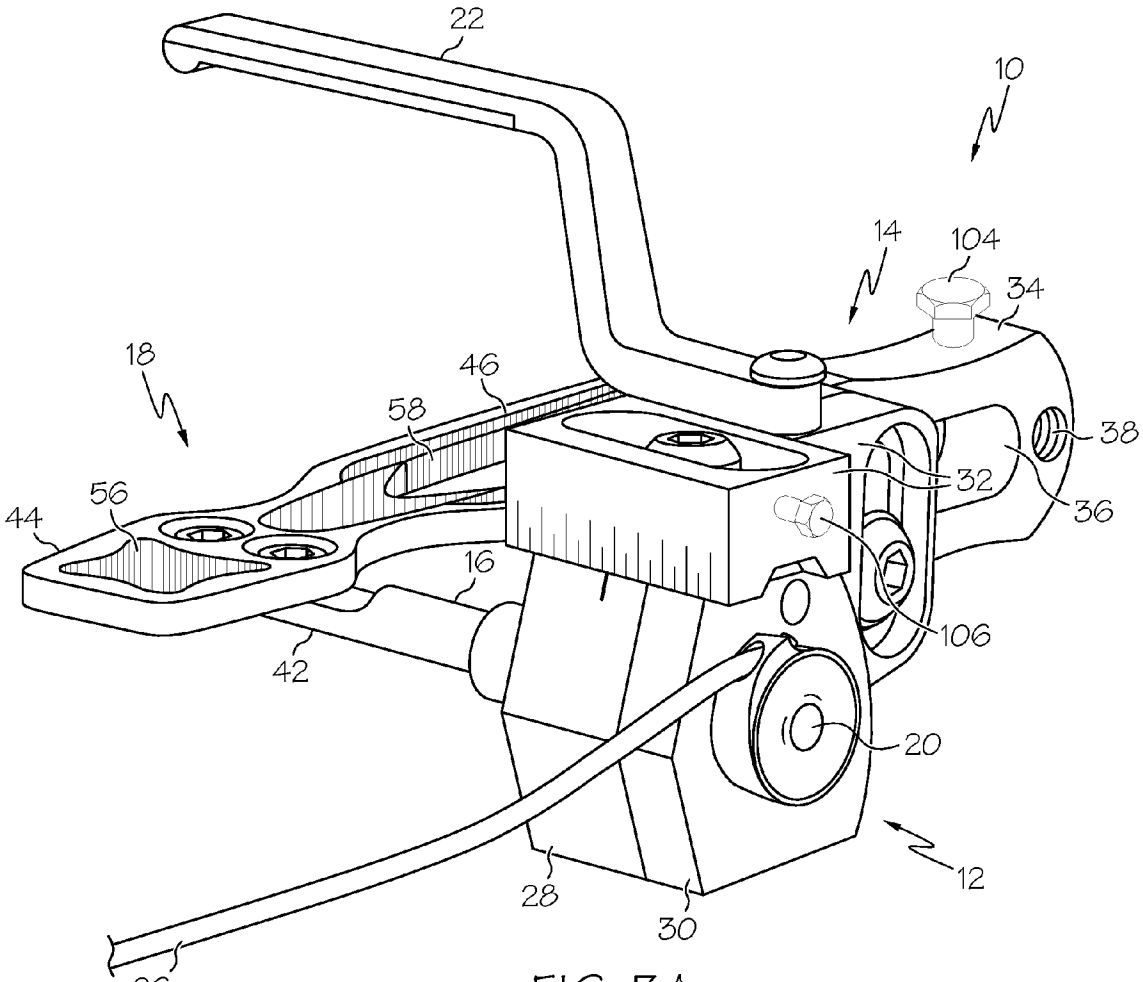
FIG. 3A is perspective view of a fall away arrow rest in accordance with one embodiment of the present invention illustrating the launcher in a lowered position.
Figure 3B:
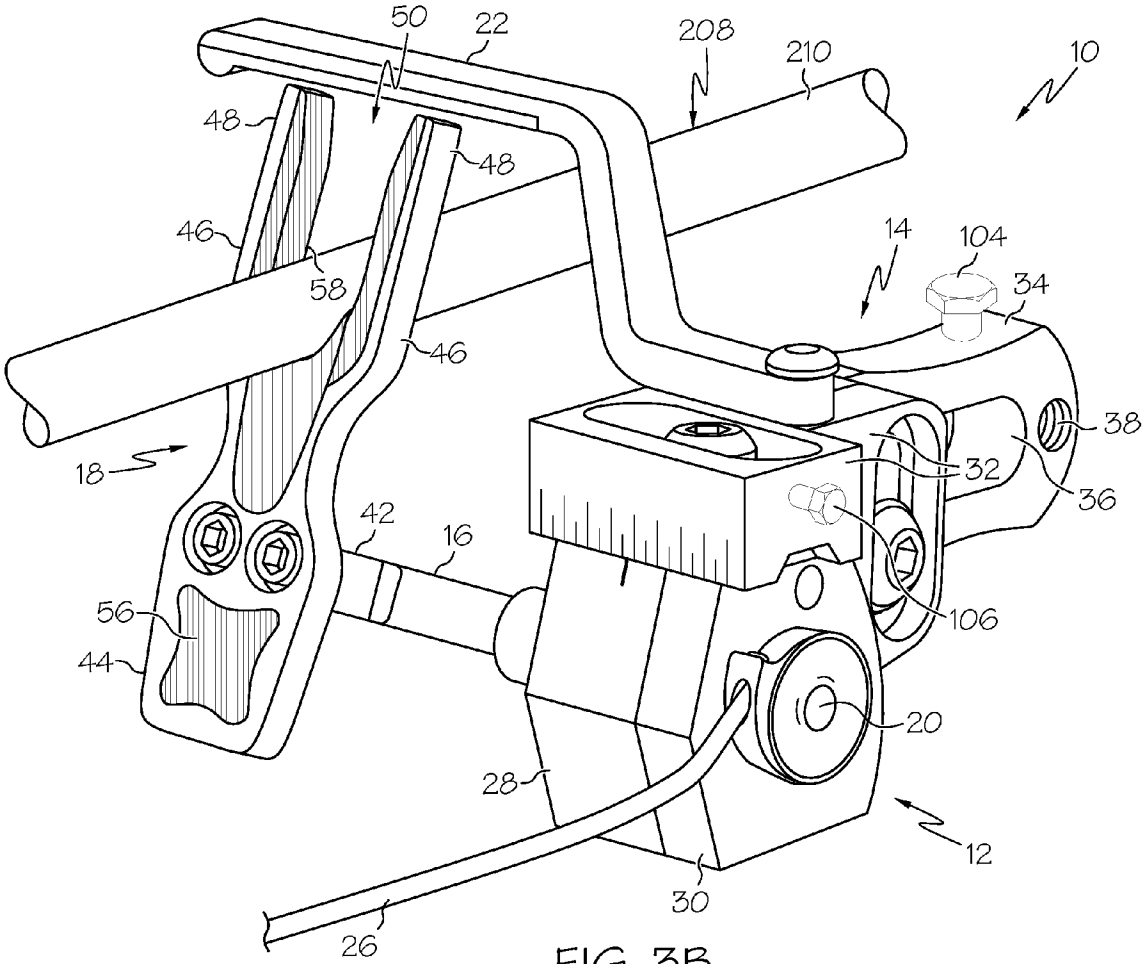
FIG. 3B is a perspective view of the fall away arrow rest of FIG. 3A illustrating the launcher in an upright support position.
Figure 5A:
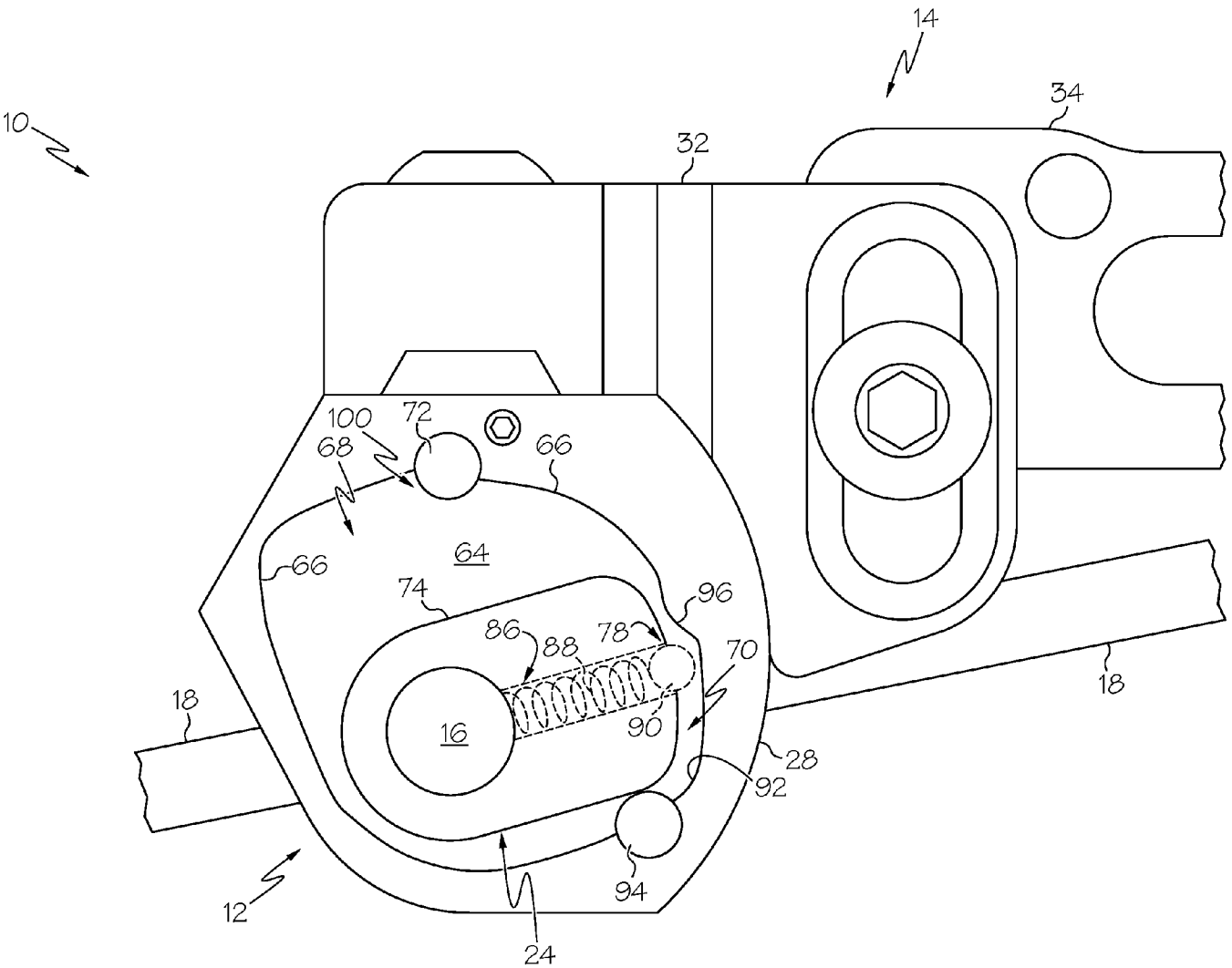
FIG. 5A is a schematic right side view of a fall away arrow rest illustrating an activator in a first position and a launcher in a lowered position in accordance with one embodiment of the present invention.
Figure 5B:
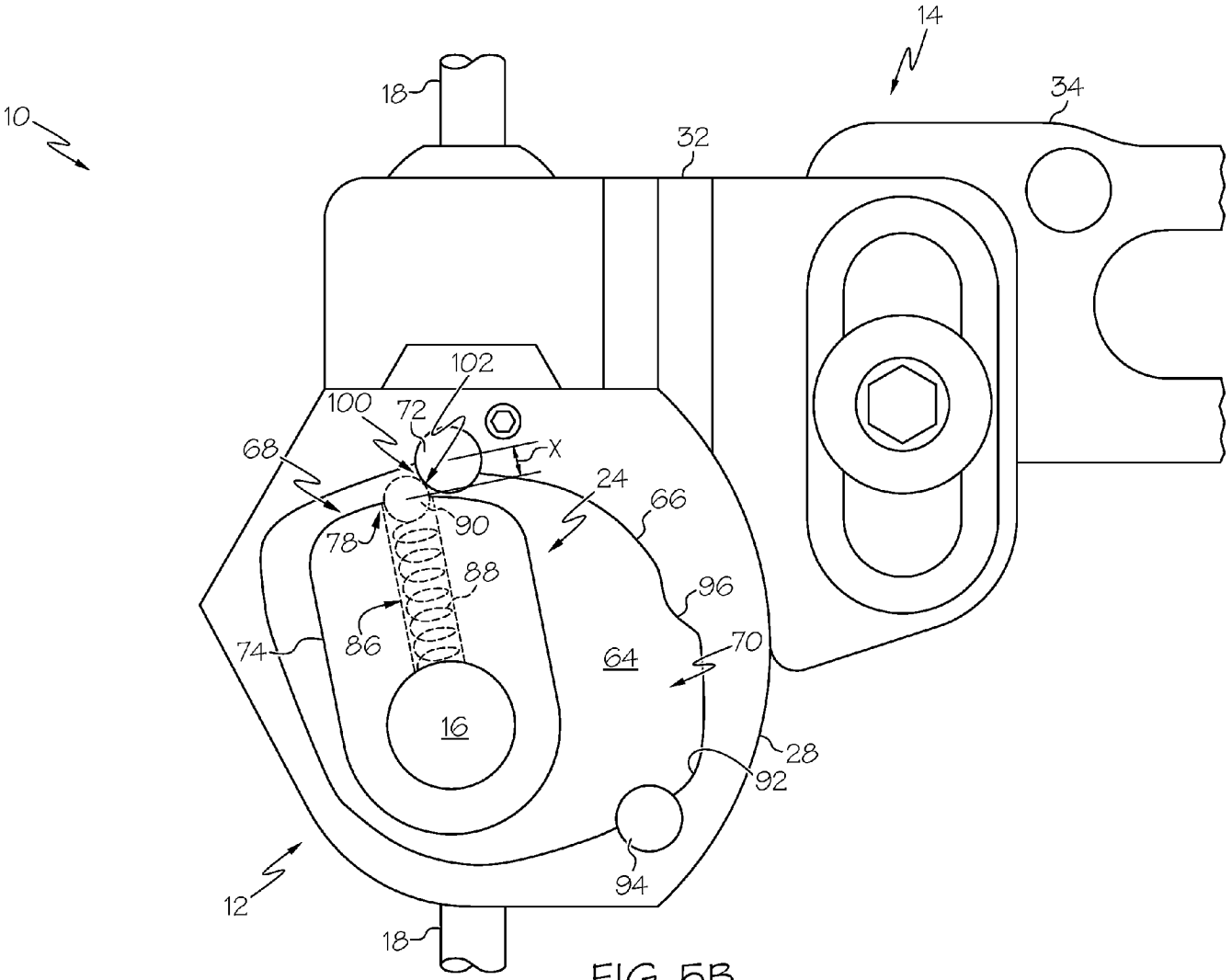
FIG. 5B is a schematic right side view of the fall away arrow rest of FIG. 5A illustrating the activator in a second position and the launcher in an upright support position in accordance with one embodiment of the present invention.
Figure 5C:
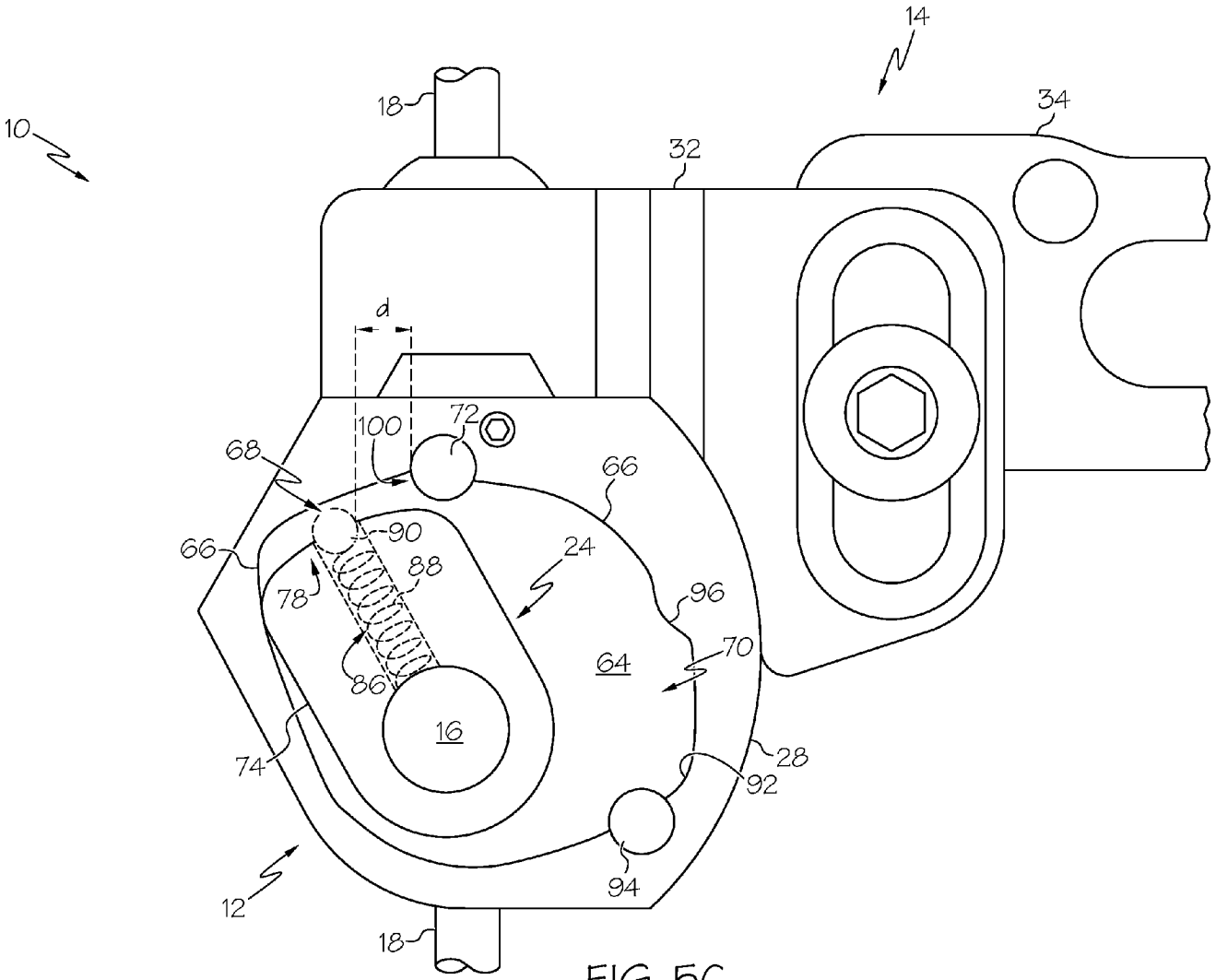
FIG. 5C is a schematic right side view of the fall away arrow rest of FIG. 5A illustrating the activator in a third position and the launcher in an upright drawn position in accordance with one embodiment of the present invention.

Turning now to FIG. 2, the various external components of arrow rest device 10 are illustrated in greater detail. Arrow rest 10 can generally include a housing 12 for attachment to compound bow 200 via a mounting structure 14, a shaft 16 rotatably mounted with housing 12 and extending generally laterally therefrom, a launcher 18 affixed to one end of shaft 16 for rotation therewith, a cord mount 20 (as shown in FIGS. 3A and 3B) affixed to the other end of shaft 16 for rotation therewith, and a containment arm 22 pivotably secured to an upper surface of the housing 12 or mounting structure 14. Disposed within housing 12 may be an activator 24 (as best shown in FIGS. 5A-5C and described in greater detail below) for inducing rotation to shaft 16 and causing launcher 18 to move between a lowered position, an upright support position and a upright drawn position. As shown in FIG. 2, containment arm 22 can be positioned to generally overlie launcher 18 (in a working position) when launcher 18 is in the upright support position and can function to prevent the user from accidentally jarring arrow 208 off of launcher 18 when moving bow 200. Containment arm 22 can also be rotated to a nonuse position when loading arrow 208 onto launcher 18 and then rotated back to the working overlying position once arrow 208 is on launcher 18.

FIGS. 3A and 3B show arrow rest device 10 with a cord 26 that can be attached to cord mount 20 at one end and attached to bow cable 206 (as demonstrated in FIG. 1) at the other end so that when bow string 204 is pulled back, bow cable 206 travels in the vertical direction causing a tension in cord 26. Cord mount 20 can be configured so that cord 26 can be connected to cord mount 20 at a position away from its axis of rotation. As a result, the tension created in cord 26 (by pulling bow string 204) can create a rotational force about the axis of rotation of cord mount 20. This rotation can cause a corresponding rotation in shaft 16, thereby moving launcher 18 from the lowered position to the upright support position and eventually the upright drawn position as described in greater detail herein. FIGS. 3A and 3B show the positioning of cord mount 20 relative to the lowered and upright positions of launcher 18, respectively.

Arrow rest 10 can be used by placing shaft 210 of an arrow 208 on launcher 18 and engaging the nock (not shown) of tail section 212 of arrow 208 with bow string 204 so that bow 200 fires or shoots arrow 208 in a longitudinal direction forwardly of launcher 18. Arrow rest 10, and more particularly activator 24, can be configured to move launcher 18 from the upright support position, as shown in FIG. 3B, to the lowered position, as shown in FIG. 3A, so arrow 208 does not contact launder 18 as travels past arrow rest 10. As described in greater detail below, activator 24 can have three positions corresponding to the positions of launcher 18. When launcher 18 is in the lowered position, activator 24 can be in a first or lowered position. When launcher 18 is in the upright support position (where it is orientated for supporting an arrow 208), activator 24 can be in a second or generally upright position. When launcher is in the upright drawn position (when bow 200 has been fully drawn), activator 24 can be in a third or generally tilted position In order to avoid arrow 208, launcher 18 can rotate downward or otherwise away from the flight path of arrow 208 (i.e., from the upright support position to the lowered position) and out of the way of a fired arrow 208. While the figures depict arrow rest 10 configured so that launcher 18 can rotate about a generally horizontal axis, it will also be appreciated that launcher 18 can rotate about an axis oriented at any desired angle relative to bow 200 or arrow rest 10. For example, arrow rest 10 can be configured so that launcher 18 can be oriented transversely and can rotate about a generally vertical axis.

Housing 12, as best shown in FIG. 2, can include a support component 28 and a housing cover 30. Housing 12 can be coupled or otherwise secured to bow 200 through mounting structure 14 that can include an intermediate component 32 and a bracket 34 having apertures 36 and 38 that can be used to secure housing 12 to frame 202 of bow 200. As shown in FIG. 2, intermediate component 32 and bracket 34 can include slotted connections so that the position of launcher 18 can be adjusted both vertically and horizontally to ensure that fletching 214 of arrow 208 does not come into contact with launcher 18 or any other part of arrow rest 10 when arrow 208 is fired. As demonstrated in FIGS. 3A and 3B, mounting structure 14 can include a vertical micro-adjustment means 104 and/or horizontal micro-adjustment means 106. Vertical micro-adjustment means 104 can enable a user to slightly adjust the position of arrow rest 10 with respect to bow 200 in the vertical direction so that an arrow 208 can be more accurately fired. Similarly, horizontal micro-adjustment means 106 can enable the user to slightly adjust the position of arrow rest 10 with respect to bow 200 in the horizontal direction so that launcher 18 can be aligned with bow 200 to ensure proper trajectory of an arrow 208. Both micro-adjustment means 104 and 106 can allow the user to make small, fine-tuned adjustments.

As further shown in FIG. 2, housing 12 can also be rotatably coupled with rotatable shaft 16 so that housing 12 remains fixed relative to shaft 16 when a rotation to shaft 16 is caused. Such a configuration can allow launcher 18 to rotate relative to housing 12, and therefore bow 200 as well. Within housing 12 are the mechanical components of arrow rest 10 that can enable launcher 18 to transition between the upright and lowered positions and operate arrow rest 10 as described in further details below.

Rotatable shaft 16 can include a first portion 40 rotatably mounted within housing 12 and extending transversely therefrom in a cantilevered fashion to a second portion 42 where launcher 18 can be fixedly mounted as shown in FIGS. 3A and 3B. Cord mount 20 can also be fixedly mounted onto the terminal end of the first portion 40 of shaft 16 and adjacent to housing 12, as shown in FIGS. 3A and 3B, so that when tension is applied to cord 26 to rotate cord mount 20, rotation of the shaft 16 is caused. Cord mount 20 can also be mounted any other portion of shaft 16.

Figure 4B:
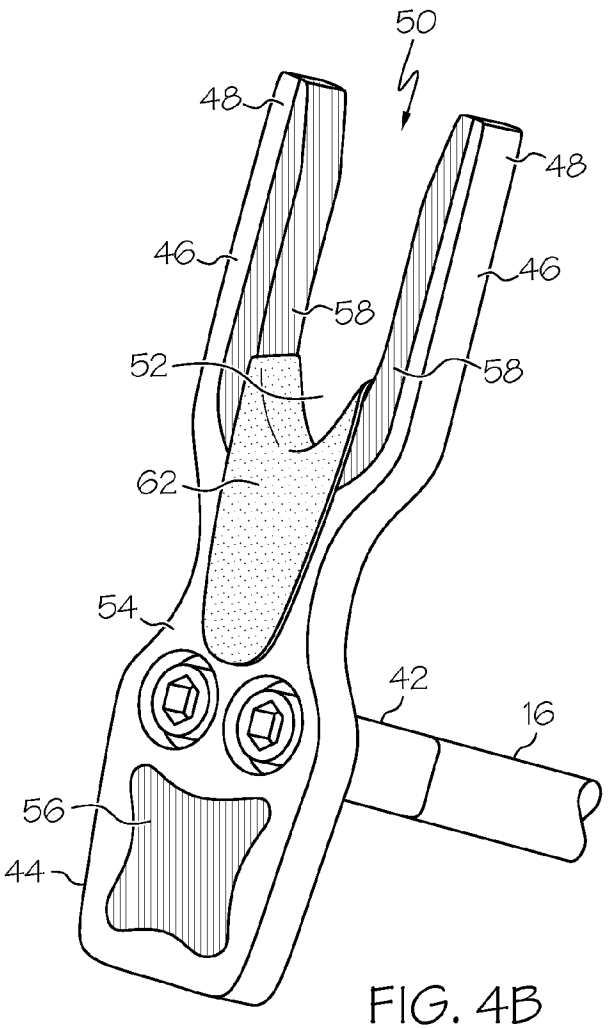
FIG. 4B is a perspective view of a launcher in accordance with a second embodiment of the present invention.
Figure 4A:
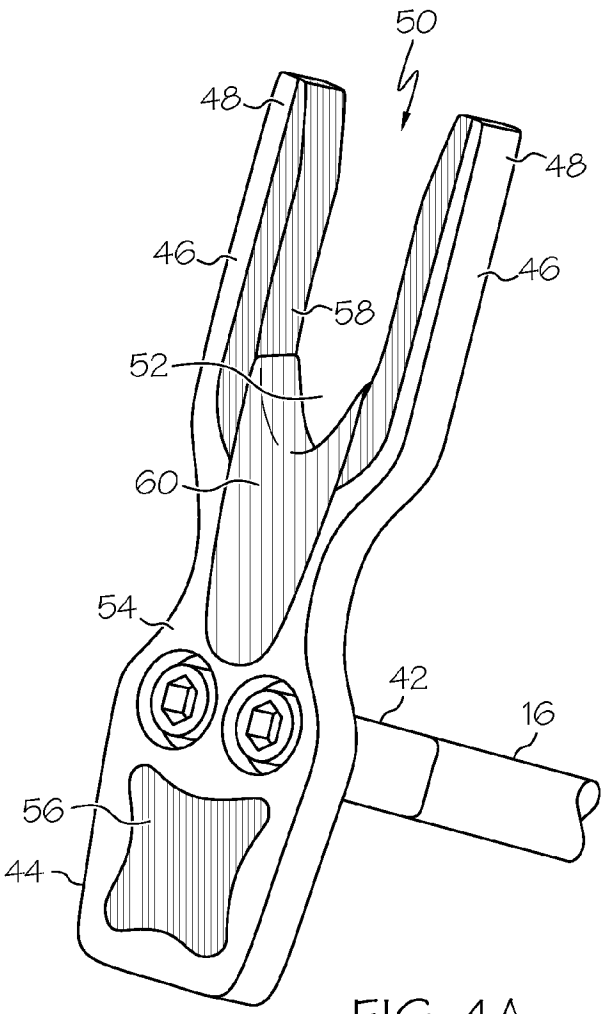
FIG. 4A is a perspective view of a launcher in accordance with a first embodiment of the present invention.

Turning to FIGS. 4A and 4B, launcher 18 can include a base 44 that is suitable for rigid attachment with rotatable shaft second portion 42 and a pair of arms 46 extending from base 44 in a direction away from shaft 16. The terminal ends 48 of arms 46 can form a channel 50 for accommodating an arrow shaft 210 therein. Arms 46 can converge at base 44 to form a notch 52 where arrow shaft 210 may rest as best shown in FIGS. 4A and 4B. As depicted, launcher 18 can be constructed from two or more materials. In one embodiment, at least a portion of launcher 18, as represented by the unhatched area 54 (including portions of aims 46 and base 44) in the figures, can be formed of a first generally rigid material having a first hardness. Other portions of the launcher, as represented by the hatched areas 56 and 58, can be formed of a second softer material having a second hardness that is less than the first hardness. The first material may include metallic materials, wood, carbon fiber or graphite reinforced polymers, plastics, including but not limited to polypropylene, polyamides, polycarbonates, polybutylene terephthalate, acrylonitrile butadiene styrene, polyethylene terephthalate, polyethylene, polystyrene, thermoplastic polyurethane, or any other suitable material now know or hereafter developed and any combinations thereof. The first material can have any suitable hardness or durometer. In one embodiment, the first material can have a hardness of about 65 or more Shore D. The second material can include any suitable material such as an elastic polymer material, natural or synthetic rubber, plastics, any other suitable material now know or hereafter developed and combinations thereof. The second material can have any suitable hardness durometer. In one embodiment, the second material can have a hardness of about 70 or less Shore A.

According to one embodiment, the first material is a molded plastic material and the second material is an overmolded elastic polymer material, such as rubber. In such an embodiment, launcher's 18 base 44 and arms 46 can generally be formed as a unitary element of plastic and include areas 56 and 58 of overmolded rubber. Rubber portions 56 and 58 can overlie and/or be embedded in at least portions of arms 46 and base 44. An area 60 proximate notch 52 can either be formed of the first material, the second material or different third material having properties differing from the first and second materials. The softer second material, as may be located in areas 56, 58 and 60, can be provided in order to reduce or substantially eliminate the noise developed as arrow shaft 210 moves or rattles within channel 50 or notch 52. Thus, launcher 18 can be desirably quiet (due to the softer second material) yet still have adequate stiffness and rigidity (due to the harder first material). In one embodiment, as indicated in FIG. 4B, a portion of launcher 18 proximate notch 52 can be covered with a material, such as a moleskin material, as represented by the raised stippled area 62.

Figure 6:
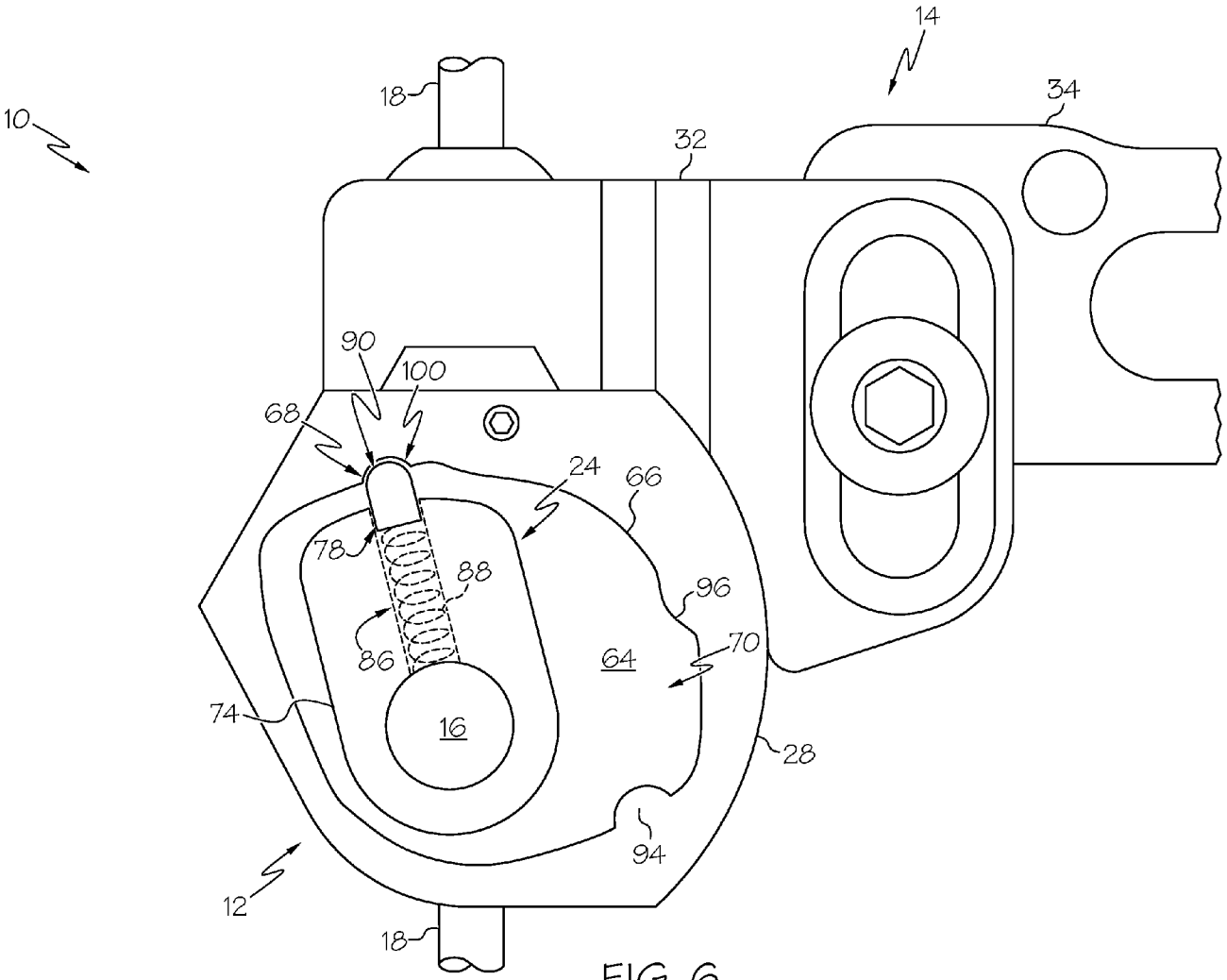
FIG. 6 is a schematic right side view of a fall away arrow rest in accordance with another embodiment of the present invention illustrating an activator in a second position and a launcher in an upright support position.

Support component 28 and activator 24 will now be described in greater detail with continuing reference to the aforementioned figures, and with particular reference to FIGS. 5A-5C. A cavity 64 can be formed in support component 28 of housing 12 into which first portion 40 of shaft 16 can extend. Activator 24 can be housed within cavity 64 of support component 28. Cavity 64 can include a defined cavity wall 66 that can be either arcuate as shown or straight and can have a first indentation 68 and a second indentation 70 defined therein, as will be described in in further detail below. In an alternative embodiment, cavity wall 66 can include only a first indentation 68. Cavity wall 66 can also be selectively arranged in order to limit and/or enable rotation of activator 24. In such an arrangement, cavity wall 66 can be dimensioned relative to activator 24 to allow activator 24 to rotate within cavity wall and to facilitate or limit rotation at various locations of cavity wall 66 due to the shape and/or size of cavity wall 66. Additionally, located within wall 66 can be a dowel pin 72 that can project slightly past wall 66 and into cavity 64 so that it can create a bulge or similar protrusion within cavity wall 66. A notch 100 can be created within first indentation 68 by the placement of dowel pin 72 with respect to wall 66. Dowel pin 72 can be selectively positioned to enable launcher 18 to remain in the generally upright position when rotated due to activator 24. In alternative arrangement, cavity wall 66 can be formed with a slight bulge or similar protrusion in place of dowel pin 72 so as to create a notch 100 within first indentation 68. In yet another arrangement, wall 66 can contain a first indentation 68 formed therein in the form of a rounded void having an edge that can create a notch 100, as best shown in FIG. 6.

Within support component 28 and cavity 64 can be a torsional biasing element 76 (as best shown in FIG. 2) having one end connected to housing 12 and the other end connected to shaft 16 to selectively urge rotation of shaft 16 relative to housing 12, thereby selectively urging rotation of activator 24 connected to shaft 16. Torsional biasing element 76 can also be connected to activator 24 in alternative embodiments of the invention. Torsional biasing element 76 can be a torsion spring having a first end (not shown) placed within a groove (not shown) defined in first portion 40 of shaft 16 and a second end 80 placed within a groove 82 defined in housing 12, as illustrated in FIG. 2. According to one embodiment, torsional biasing element 76 is adapted for urging rotation of activator 24 and shaft 16 so that launcher 18 is biased for placement in the lowered position. This may be accomplished by selectively orienting activator 24 such that torsional biasing element 76 is subjected to less angular deflection and bending stress when launcher 18 is in the lowered position as opposed to the upright support position or the upright drawn position. In such an embodiment, when launcher 18 is not statically placed in the upright support position, torsional biasing element 76 can urge rotation and/or actually cause rotation of shaft 16 to move launcher 18 in the direction of the lowered position.

Figure 7C:
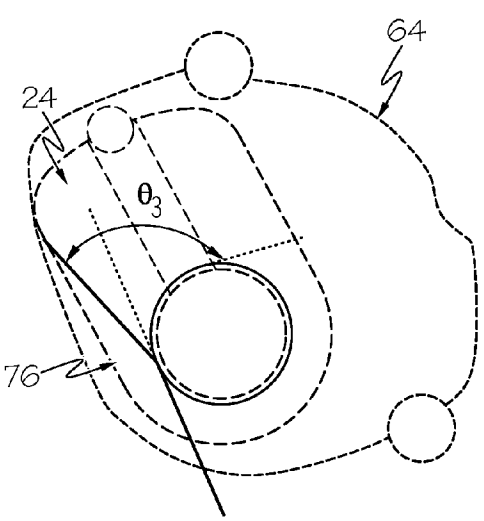
FIG. 7C is a diagrammatic right side view of the fall away arrow rest of FIG. 5C illustrating the angular deflection of a torsional biasing element when the activator is in the third position and the launcher is in the upright drawn position.
Figure 7B:
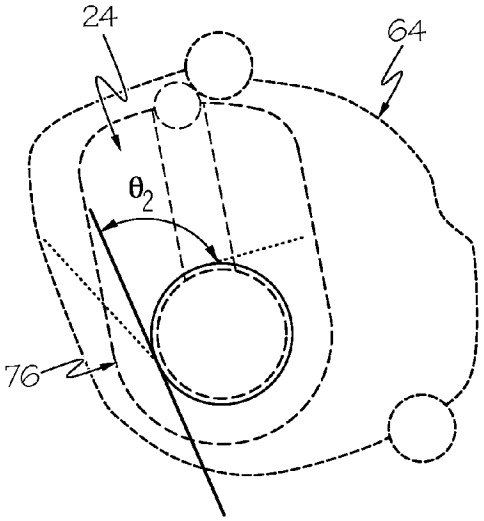
FIG. 7B is a diagrammatic right side view of the fall away arrow rest of FIG. 5B illustrating the angular deflection of a torsional biasing element when the activator is in the second position and the launcher is in the upright support position.
Figure 7A:
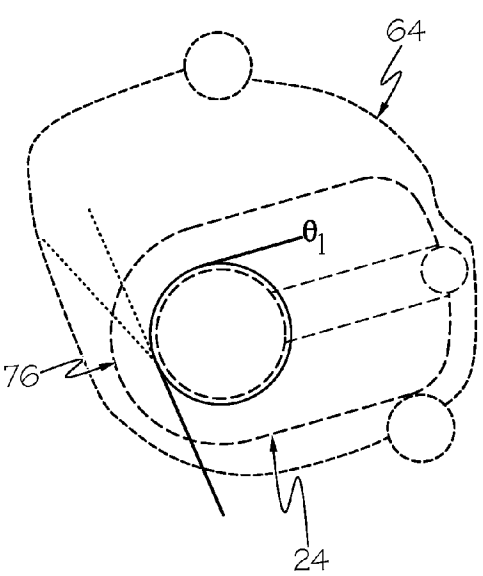
FIG. 7A is a diagrammatic right side view of the fall away arrow rest of FIG. 5A illustrating the angular deflection of a torsional biasing element when the activator is in the first position and the launcher is in the lowered position.

Torsional biasing element 76 can have a restoring constant $K_T$ such as a spring force in a torsional spring. When activator 24 is rotated upward from the first or lowered position (as shown in FIG. 3A), the first end of torsional biasing element 76, which is coupled to shaft 16, can rotate upward and create a bending stress within torsional biasing element 76 to urge rotation of activator 24 back to first or lowered position. This can create a torque, or moment, $\tau$ on shaft 16 about its rotational axis urging of rotation of shaft 16. The torque $\tau$ provided by torsional biasing element 76 can be calculated using the Hooke's Law formula: $\tau=K_T\times\theta$, where $\theta$ is the angle of displacement of the first end of torsional biasing element 76 (coupled with shaft 16) with respect to the second end of torsional biasing element 76 (coupled with housing 12) and $K_T$ is the restoring constant of torsional biasing element 76. The deflection angle $\theta$ can increase as activator 24 is rotated from the first position (as shown in FIGS. 5A and 7A) to the second position (as shown in FIGS. 5B and 7B) and then to the third position (as shown in FIGS. 5C and 7C), thereby increasing the torque r applied about shaft 16.

Activator 24 can include a body 74 that can be rigidly attached to first portion 40 of shaft 16 and a stopping component 78 for regulating rotation of shaft 16. Stopping component 78 can be housed at least partially within body 74. Body 74 and stopping component 78 can also be selectively adapted to interact with cavity wall 66 as illustrated in the figures.

As best shown in FIGS. 5A-5C, activator 24 can be situated in three different positions within cavity 64, depending on the positioning of launcher 18. As shown in FIG. 5A, when launcher 18 is in its lowered position, activator 24 can be in the first position where stopping component 78 can be located away from first indentation 68 and near or at least partially within second indentation 70. As shown in FIG. 5B, when launcher 18 has been rotated upwards into the upright support position and stopping component 78 is resting against notch 100 (described in greater detail below), activator 24 can be in a second position. In this second position, stopping component can be at least partially located within first indentation 68. Finally as shown in FIG. 5C, when launcher 18 has been rotated beyond the upright support position to a upright drawn position and stopping component 78 is no longer resting against notch 100 but is still within first indentation 68 (described in greater detail below), activator 24 can be in a third position. In an alternative embodiment, as illustrated in FIG. 6, where first indentation 68 comprises a rounded void, stopping component 78 may no longer be positioned within first indentation 68, but instead positioned further beyond first indentation 68, activator 24 can still in the third position. It should be understood that while these three positions are described in detail, activator 24 and launcher 18 may be positioned in several alternative and/or additional positions as well.

Stopping component 78 can be a depressible detent, such as a ball detent or pin detent, movable linearly within a bore 86 defined within the activator body 74, as shown in FIGS. 5A-5C. Stopping component 78 can comprise a ball bearing 90 and a stop biasing element 88, such as a compression spring, disposed within bore 86 and beneath the ball bearing 90. The lip of bore 86 can be adapted for retaining ball bearing 90 at least partially within the bore 86. It is recognized that stopping component 78 can also be comprised of a number of alternative suitable mechanisms, such as a ball plunger or retractable pin, that are capable of inhibiting rotation of activator 24. According to one embodiment, stopping component 78 can comprise a stop biasing element 88 consisting of a compression spring and a small rod with a conical end 90 (in place of ball bearing 90), as best shown in FIG. 6. The portion of the ball bearing or conical end 90 that extends outward from bore 86 can provide the stopping feature for activator 24.

Stopping component 78 can also be selectively adapted for interacting with dowel pin 72, or similar bulge in cavity wall 66, such that a force must be applied to depress ball bearing 90 to enable the edge of activator body 74 to move past cavity wall 66 and/or dowel pin 72. Stop biasing element 88 can have a restoring constant $K_S$ that inhibits deflection of stop biasing element 88 and therefore ball bearing 90. In order for activator 24 to rotate past dowel pin 72, ball bearing 90 must deflect a distance x downward into bore 86, as shown in FIG. 5B. As a result, stop biasing element 88 provides a force $F_S$ that prevents ball bearing 90 from depressing into bore 86 unless an opposing force greater than $F_S$ is applied to ball bearing 90. The force $F_S$ may be calculated using the Hooke's Law formula: $F_S=K_S\times x$, where x is the linear displacement of the stop biasing element 88 and $K_S$ is the restoring constant of the stop biasing element 88.

When launcher 18 is in the lowered position and activator 24 is in the first position (as shown in FIGS. 5A and 7A), a force can be applied to rotate shaft 16 such that launcher 18 moves to the upright support position and activator 24 moves to the second position (as shown in FIGS. 5B and 7B) or the upright drawn position (with activator 24 in the third position as shown in FIGS. 5C and 7C). This force can be provided by creating tension in cord 26 and causing rotation of cord mount 20, or it can be provided by the user applying an upward lifting force to launcher 18 using his or her finger, both of which will cause rotation of shaft 16. It is also recognized that any other means of causing rotation of shaft 16 for this purpose can be suitably employed. Activator 24 can rotate along with shaft 16 so that stopping component 78 can travel along cavity wall 66 and can pass underneath dowel pin 72. Stop biasing element 88 can enable the ball bearing or conical end 90 to depress in order to pass along cavity wall 66 and under dowel pin 72. Once stopping component 78 passes past dowel pin 72, the ball bearing 90 can be pushed back outward by stop biasing element 88 and into the first indentation 68. Stopping component 78 may then be positioned within a notch 100 of first indentation 68 such that it rests against dowel pin 72, placing the activator 24 in the second position and the launcher in the generally resting upright position. Additionally, a rotational force may continue to be applied to shaft 16 so that activator 24 can continue to rotate until it is obstructed or nearly obstructed by cavity wall 66, as shown in FIG. 5C, where activator 24 is in the third position and launcher 18 is in the upright drawn position. When activator 24 is in this third position, stopping component 78 can remain in the first indentation 68 but need no longer be located within notch 100. In an alternative embodiment of the present invention, as shown in FIG. 6, as activator 24 rotates from the first position to the second position, stopping component 78 travels along cavity wall 66 until it enters first indentation 68 and conical end 90 may release outward and engage an edge created by the rounded void of the first indentation. When a rotational force continues to be applied, conical end 90 may be pushed back downward as it engages the rounded wall of the first indentation 68 and activator 24 can continue to rotate until it is obstructed or nearly obstructed by cavity wall 66.

When activator 24 is in the second position, ball bearing 90 can be located within notch 100 and can contact dowel pin 72 (or similar bulge in wall 66), as shown in FIG. 5A, due to the torque $\tau$ created by the selective positioning of torsional biasing element 76 and the application of a rotational moment about the axis of shaft 16. As explained above, torque $\tau$ increases as activator 24 is rotated further away from the first position due to the increase in the angle of deflection $\theta$. When activator 24 is in the second position, torsional biasing element 76 can have a deflection angle $\theta_2$. Similarly, when activator 24 is in the third position, torsional biasing element 76 can have a deflection angle $\theta_3$ and a deflection angle $\theta_1$ when in the first position, as best shown in FIGS. 7A-7C. When in the second position, the torque T, calculated as $K_T\times\theta_2$, can create a linear force $F_T$ acting on ball bearing or conical end 90 at a contact point 102, which is located the point of contact between ball bearing or conical end 90 and dowel pin 72, to oppose the force $F_S$ created by stop biasing element 88 of stopping component 78. The force $F_S$ pushes generally upward on ball bearing 90 and away from stopping component 78. The force $F_T$ is oriented perpendicular to the contact point 102 between ball bearing 90 and dowel pin 72 and opposes $F_S$. $F_T$ can be calculated using the formula $F_T=\tau/(r\times\sin\alpha)$, where r is the distance between the rotational axis of shaft 16 and the contact point 102, and $\alpha$ is the angle between $F_T$ and the axis perpendicular to force $F_S$ (or along the longitudinal axis of bore 86) is as shown in FIGS. 8A and 8B.

Both stop biasing element 88 and torsional biasing element 76 can be selectively adapted so that when activator 24 is statically placed in the second position, the force $F_S$ is slightly greater than the opposing translated vertical component of force $F_T$, denoted as $F_{Ty}$. This selective adaptation can be based on the relationship between the restoring constants $K_T$ and $K_S$, the deflection angle $\theta$ of torsional biasing element 76, and/or placement and size of dowel pin 72 (or similar bulge in wall 66) which can influence the orientation angle $\alpha$ of the force $F_T$. As a result, ball bearing or conical end 90 can be prevented from depressing into bore 86 and traveling past dowel pin 72, thereby maintaining activator 24 in the second position and the launcher 18 in the upright support position. A schematic diagram of the interaction of the forces is shown in FIGS. 8A and 8B.

In order for activator 24 to rotate from the second position to the first position, an opposing force greater than $F_S$ of stop biasing element 88 must be applied to depress ball bearing 90 into bore 86 and allow stopping component 78 to move underneath dowel pin 72. Once the stopping component 78 moves past dowel pin 72 and away from first indentation 68, the torsional biasing element 76 urges rotation of activator 24 into the first position where launcher 18 is in the lowered position. This opposing force can be provided solely from the rotational moment or torque $\tau$ about the rotational axis of shaft 16 created by torsional biasing element 76 or provided in combination with another, separate force. As explained above, torque $\tau$ creates a linear force $F_T$ perpendicular to the contact point 102 between ball bearing 90 and dowel pin 72 which has a translated vertical component force $F_{Ty}$ directly opposing $F_S$. The vertical component force $F_{Ty}$ can be greater than $F_S$ when the torque $\tau$ about shaft 16 is increased, either by increasing the deflection angle $\theta$ or torsional biasing element 76 and/or applying an outside rotational moment or force. When component force $F_{Ty}$ is greater than $F_S$, ball bearing 90 depresses into bore 86 and stopping component 78 can move past notch 100 and dowel pin 72, thereby rotating activator 24. Activator can then rotate through cavity 64 from the second position shown in FIG. 5B towards the first position as shown in FIG. 5A.

Cavity 64 can have an arcuate wall 66 with a sliding surface that the ball bearing 90 of stopping component 78 can freely slide against once stopping component 78 clears dowel pin 72 and activator 24 begins rotation towards the first position. Alternatively, wall 66 can be positioned further away so that there is a gap between stopping component 78 and wall 66 as activator 24 moves between the first position and second position. Rotation of activator 24 and shaft 16 can continue until activator body 74 reaches a rotation limiting wall 92 of cavity 66. A rubber damper or stop 94 or similar object may be placed on rotation limiting wall 92 to engage the activator body 74 when it reaches the second position as shown in FIG. 5B. Rotation limiting wall 92 and/or the rubber damper 94 can prevent activator body 74 from rotating beyond the first position.

Cavity wall 66 can also be selectively arranged so that activator 24 can rotate beyond the second position and away from the first position into the third position. When in the third position, there is a distance "d" between the stopping component 78 and dowel pin 72 (or alternatively a bulge in wall 66). Activator 24 can be moved into the third position as a result of the rotational force created by the tension in cord 26 and rotation of cord mount 20 when the bow string 204 of bow 200 is drawn back (or by any other suitable means). Placement of activator 24 in the third position can increase the torque $\tau$ applied about the axis of rotation of shaft 16. This can be due to the increase in the deflection angle $\theta$ of torsional biasing element 76. As explained above, when activator 24 is in the third position, torsional biasing element 76 has a deflection angle $\theta_3$ which is used in calculating the torque $\tau$ through the formula: $\tau=K_T\times\theta_3$. Accordingly, the torque $\tau$ supplied by torsional biasing element 76 can be greater when activator 24 is in the third position than when in the second position. When activator 24 is released from the third position, such as when the drawn bow string 204 is released, activator 24 can rotate toward the second position with a torque $\tau$ equal to $K_T\times\theta_3$. The increased torque $\tau$ increases the linear force $F_T$ at the contact point 102 when ball bearing 90 reaches dowel pin 72, thereby increasing the translated vertical component force $F_{Ty}$ that opposes the force $F_S$ pushing upward on ball bearing 90. When activator 24 is freely released from the third position, $F_{Ty}$ may be greater than $F_S$ and ball bearing 90 of stopping component 78 may depress into bore 86 as it contacts dowel pin 72, enabling activator 24 to move from the third position to the second position to the first position. Accordingly, launcher 18 moves from the upright drawn position to the upright support position to the lowered position. A schematic of these interactions is shown in FIGS. 8A and 8B.

Cavity 64 may also have a second indentation 70 with a ramp 96 formed into cavity wall 66. Such a design can entirely prevent or at least substantially eliminate any undesirable bounce back of activator body 74 and launcher 18 once activator 24 reaches the first position and launcher 18 has reached its lowered position. Once activator 24 nears the first position, second indentation 70 can allow ball bearing 90 of stopping component 78 to return to an extended position. As such, ball bearing 90 can engage ramp 96 as activator 24 approaches its first position. Once activator 24 reaches the first position, ball bearing 90 can continue engagement with ramp 96 to prevent activator body 74 (and thus launcher 18) from bouncing back towards its second position. In one embodiment, the linear force $F_S$ created by stop biasing element 88 of stopping component 78 against angled ramp 96 urges activator 24 towards its first or lowered position. This in turn can counteract any bounce back that activator body 74 would otherwise undergo and can keep activator 24 (and thus launcher 18) in its lowered position. Once activator 24 is in the first position and launcher 18 is in the lowered position, as depicted in FIGS. 5A and 7A, activator 24 and launcher 18 can be in generally releasably secured positions. The rotation of activator 24 and launcher 18 can be restricted in both a clockwise direction and a counterclockwise direction.

Second indentation 70 can be of any suitable size and depth and ramp 96 can be disposed at any suitable angle in order to prevent bounce back as activator body 74 contacts rotation limiting wall 92 and/or rubber damper 94. As will be appreciated, second indentation 70 need not extend clear to the rotation limiting wall 92 and only needs to be sized to accommodate the width of ball bearing 90. In another embodiment, second indentation 70 does not include a ramp 96 but rather has a steeper surface that creates a notch holding stopping component 78 in place.

Two possible methods of using the arrow rest 10 in connection with a bow 200 will now be described with reference to the aforementioned figures. However, it is understood these described methods are considered exemplary only and the use of alternative methods is considered within the scope of the present invention. In the first described method of use, a user first grasps launcher 18 and rotates it upwardly from the lowered position (shown in FIG. 3A) to the upright support position (shown in FIG. 3B). If containment arm 22 has been rotated away from the working position so that it does not overlap launcher 18, then an arrow 208 can be loaded onto launcher 18 in the upright arrow support position to prepare for arrow firing. Then, containment arm 22 can be swung to the working position in order to overlap arrow 208 that is positioned on launcher 18. On the other hand, if containment arm 22 is already in the working position, then arrow 208 can be loaded onto launcher 18 in the lowered position prior to rotating launcher 18 to the upright support position. In either case, once arrow 208 is loaded on launcher 18, containment arm 22 is in the working position, and launcher 18 is in the upright support position, a vertical gap formed between terminal ends 48 of launcher arms 46 and containment arm 22 is preferably less than the diameter of a standard arrow 208, so that arrow 208 does not slip over launcher arms 46 and fall off of launcher 18. Corresponding to launcher 18 being in the upright support position, activator 24 is in the second position (as shown in FIG. 5B) where body 74 has been rotated away from rotation limiting wall 92 and ball bearing 90 of stopping component 78 has engaged notch 100 of first indentation 68 of housing cavity 64. In rotating activator 24 from the first position to the second position, ramp 96 pushes and guides stopping component 78 and ball bearing 90 to a depressed position within bore 86 of activator body 74. The user can then engage tail section 212 of arrow 208 with bow string 204 and draw back bow string 204 to prepare for arrow firing. This creates a tension in cord 26 which causes rotation of cord mount 20, thereby rotating shaft 16 and placing the activator 24 in the third position (as shown in FIG. 5C).

In the second described method of use, arrow 208 is first loaded onto launcher 18 in the lowered position. Tail section 212 of arrow 208 is also engaged with bow string 204 to prepare for firing. Drawing bow string 204 back causes cord 26, which is clipped to bow string 204 or to bow cable 206, to pull on cord mount 20, which is fixedly attached to the terminal end of second portion 42 of shaft 16. As shown in FIGS. 3A and 3B, cord 26 is connected to cord mount 20 at a location radially away from its center. As a result, when cord 26 has tension applied thereto, cord mount 20 rotates about its center as is shown in FIGS. 3A and 3B, which illustrates the different orientations of cord mount 20 when launcher 18 is in the lowered position and in the upright support position. The tension applied to cord 26 by drawing back bow string 204 creates sufficient rotational force (via cord mount 20) about shaft 16 to rotate activator 24 (through rotation of cord mount 20 and shaft 16), and ball bearing 90 of stopping component 78 depresses and slides along ramp 96 and cavity wall 66 until it passes underneath dowel pin 72 and enters first indentation 68 and notch 100 of cavity wall 66. This rotation of cord mount 20, and therefore shaft 16, can also cause launcher 18, which is fixedly mounted to the first portion of shaft 16, to rotate from the lowered position to the upright support position. The raised lateral portions of the launcher arms 46 aid in maintaining the arrow 208 on the launcher 18 as the launcher 18 is rotating upward to the upright support position. The softer second material located at 56 on base 44 aids in preventing arrow shaft 210 from contacting the first harder material and thereby eliminates or at least significantly reduces noise associated with loading the arrow 208 in this manner. As bow string 204 is pulled back sufficiently to fire arrow 208, the tension in cord 26 enables further rotation of activator 24 so that it moves from the second position to the third position.

When the user releases bow string 204 to fire the arrow 208, activator 24 moves from the third position to the second position. As explained above, the torque $\tau$ (equal to $K_T \times \theta_3$) about the rotational axis of shaft 16 creates a force $F_T$ at ball bearing 90 as it contacts dowel pin 72 greater than the opposing force $F_S$ supplied by stopping component 78. Therefore, when stopping component 78 reaches notch 100 and contacts dowel pin 72 (or alternatively a bulge in wall 66), ball bearing 90 can depress a distance x into bore 86 and move out of notch 100 and past dowel pin 72. The torsional biasing element 76 can then urge continued rotation of activator 24 to the first position. Ball bearing 90 or stopping component 78 can remain in a partially depressed position until it reaches ramp 96 of the second indentation 70 of cavity wall 64 where it can begin to release to an extended position. Activator 24 can then cease to rotate once it reaches the first position and activator body 74 contacts rubber damper 94 and/or rotation limiting wall 92. The rotation of activator 24 corresponds to a rotation in shaft 16, which corresponds to a rotation in launcher 18. As a result, launcher 18 rotates from the upright drawn position to the upright support position to the lowered position before arrow 208 completely passes through arrow rest 10. This allows arrow 208 to pass through arrow rest 10 without arrow tail section 212 or fletching 214 contacting arrow rest 10. In other words, launcher 18 rotates out of the flight path of arrow 208 so that tail section 212 or fletching 214 of arrow 208 does not contact launcher 18 as arrow 208 travels past launcher 18.

The operation of the components of arrow rest 10 according to one embodiment of the invention will now be described in more detail with reference to FIGS. 7A-7C and 8A and 8B. Activator 24 can be oriented on shaft 16 so that when activator 24 is in the first position, second position, and third position, torsional biasing element 76 has a deflection angle of $\theta_1$, $\theta_2$, and $\theta_3$, respectively, where $\theta_1<\theta_2<\theta_3$, as schematically shown in FIGS. 7A-7C. When activator 24 is rotated upward from the first position and placed in the second position, torsional biasing element 76 creates torque a $\tau$ equal to $K_T$ multiplied by the second deflection angle $\theta_2$ ($\tau=K_T\times\theta_2$) in activator 24. Because rotation of shaft 16 (and activator 24) is restricted due to the fact that dowel pin 72 obstructs stopping component 78 from passing by, a force $F_T$ is created by the torque $\tau$ perpendicular to contact point 102, at a distance r from the rotational axis of shaft 16, and at an angle $\alpha$ from an axis perpendicular to the longitudinal axis of bore 86 (or from an axis parallel to force $F_S$ as best shown in FIGS. 8A and 8B. Force $F_T$ can be described as $F_T=\tau/[r\times\sin(\alpha)]$ and can push in the downward direction against ball bearing 90. Stop biasing element 88 of stopping component 78 supplies a force $F_S$ in the upward direction against ball bearing 90 along the longitudinal axis of bore 86. The force $F_T$ has a translated vertical component $F_{Ty}$ that is directly opposed to $F_S$ along the longitudinal axis of bore 86. Ball bearing 90 must deflect downward a distance x in order to move past dowel pin 72. As a result $F_S$ can be described as $F_S=K_S\times x$. In order to prevent ball bearing or conical end 90 from depressing into bore 86 allowing activator 24 to move to the first position, the force $F_{Ty}$ must be less than the force $F_S$.

When activator 24 is placed into the third position, the torque $\tau$ about the rotational axis of shaft 16 can now be described as $\tau=K_T\times\theta_3$. When freely released from the third position, activator 24 rotates toward the second position and ball bearing 90 contacts dowel pin 72. At this contact point 102, the downward force $F_T$ applied to ball bearing 90 can be described as $F_T=\tau/[r\times\sin(\alpha)]$, where $\tau=K_T\times\theta_3$. However, the upward force applied by stop biasing element 88 remains the same as when activator 24 was statically placed in the second position and remains defined as $F_S=K_S\times x$. In order for ball bearing 90 to depress a distance x into bore 86 allowing activator 24 to move to the first position, the vertical component force $F_{Ty}$ of $F_T$ must be greater than $F_S$. Using the above defined formulas, the operation of arrow rest 10 can be achieved using the following formulas:

$$F_{Ty}<F_S(\text{from second position})\rightarrow[K_T\times\theta_2\times\cos(\alpha)]/[r\times\sin(\alpha)]<K_S\times x$$

$$F_{Ty}>F_S(\text{from third position})\rightarrow[K_T\times\theta_3\times\cos(\alpha)]/[r\times\sin(\alpha)]>K_S\times x$$

The above formulas may be satisfied by selectively adapting torsional biasing element 76, stop biasing element 88, cavity wall 66, dowel pin 72, and/or activator 24 in a number of different combinations.

The use of stopping component 78 and dowel pin 72 (or alternatively a bulge in wall 66) can enable the user to slowly let down bow string 204 when making a decision not to fire a drawn arrow 208. The configuration allows arrow rest 10 to remain in the upright support position, even when bow string 204 is fully let down. When bow string 204 is slowly let down, the tension in cord 26 decreases at a much slower rate than when bow 200 is fired. This decreased rate of tension reduction reduces the torque $\tau$ applied to shaft 16 as activator 24 moves from the third position to the second position (as opposed to when activator 24 is freely released from the third position). As a result, when bow string 204 is slowly let down, the torque T applied to the shaft 16 when ball bearing 90 contacts dowel pin 72 can be described in the following formula: $K_T\times\theta_3>\tau>K_T\times\theta_2$. This results in the linear force $F_T$ created by torque $\tau$ to have a vertical component $F_{Ty}$ less than $F_S$. This prevents ball bearing 90 from depressing a distance x into bore 86, thereby preventing activator 24 from passing by dowel pin 72 and into the first position. Arrow rest 10 can then continue to support arrow 208 until the user decides to redraw bow string 204 and fire arrow 208.

It should be understood that arrow rest 10 can be oriented in a number of other ways, including in the mirror image of what is shown in the figures in order to accommodate left-handed users. It should also be understood that while arrow rest 10 is shown in the figures as having a shaft 16 having a generally horizontal axis in order to rotate launcher 18 between upright and lowered positions, arrow rest 10 can be configured and mounted to bow 200 in a fashion such that launcher 18 can rotate on a different axis, such as a vertical axis, in order to move launcher 18 out of the way of arrow 208.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A fall away arrow rest system for use with a bow, said arrow rest comprising:

a housing adapted for attachment to said bow, said housing including a cavity having a wall with a first indentation and a notch defined at least partially within said first indentation;

a rotatable shaft including a first portion operably coupled to and supported by said housing and a second portion extending from said housing;

a launcher attached to said second portion of said shaft;

an activator disposed for a rotation within said cavity of said housing and coupled to said first portion of said shaft, wherein said rotation of said activator results in a rotation of said shaft and said launcher, said activator being moveable between a first position, a second position, and a third position within said housing, wherein said activator is disposed at a lowered position of rest at a first deflection angle at said first position, said activator is disposed at an upright supported position at a second deflection angle at said second position, and said activator is disposed at a fully drawn position at a third deflection angle at said third position, wherein the third deflection angle is greater than the second deflection angle, and said second deflection angle is greater than said first deflection angle;

wherein said activator comprises a stopping component that includes a depressible detent and a stop biasing element below said depressible detent, said stop biasing element applying an outward force to said depressible detent, wherein in said second position, said stopping component prevents said activator from rotating toward said first position by being received in said first indention and in engagement with a stop disposed on said wall adjacent to said notch; and a torsional biasing element operably connected to said housing at one end and to at least one of said shaft or said activator at a second end, said torsional biasing element disposed to apply a torque to said activator about a longitudinal axis of said shaft in a first rotational direction, wherein said torque applied to said activator increases from the first position to the third position;

wherein at said second position, a shape of said stop, a shape of said depressible detent, and said torque applied by said torsional biasing element at said second position effectuate a first downward force on said depressible detent, wherein said first downward force is less than said outward force;

wherein in said third position, said activator may be released for movement in said first rotational direction in one of a freely released condition or a let-down released condition, wherein in said let-down released condition, said shape of said stop, said shape of said depressible detent, said torque applied by said torsional biasing element at said second position, a force applied by a user in opposition to said torque applied by said torsional biasing element during said let-down released condition, and a first momentum of said activator traveling through a radial displacement defined by the difference between the third deflection angle and the second deflection angle effectuates a second downward force on said depressible detent upon a collision of said depressible detent and said stop, and wherein said second downward force is less than said outward force so said depressible detent retains said activator at said second position during said let-down released condition.

2. The fall away arrow rest system of claim 1 wherein in said freely released condition, said shape of said stop, said shape of said depressible detent, said torque applied by said torsional biasing element at said second position, and a second momentum of said activator freely traveling through said radial displacement effectuate a third downward force on said depressible detent upon a collision of said depressible detent and said stop, wherein said third downward force is greater than said outward force to depress said depressible detent to clear said stop thereby allowing said torsional biasing element to rotate said activator to said first position.

3. The fall away arrow rest system of claim 1 wherein said stop is a dowel pin.

4. The fall away arrow rest system of claim 1 wherein said stop is a bulge in said wall.

5. The arrow rest system of claim 1, wherein said depressible detent and said stop biasing element must depress downward a clear distance to allow said activator to move from said upright second position to said lowered first position.

6. The arrow rest system of claim 1, wherein said stop biasing element has a first restoring constant that requires a clearing downward force to depress said depressible detent a clearing distance for said depressible detent to clear said stop.

7. The arrow rest system of claim 1, wherein said stopping component comprises a ball detent.

8. The arrow rest system of claim 1, wherein said stopping component comprises a rod having a conical end.

9. The arrow rest system of claim 1 further comprising a cord mount attached to said shaft and a cord connected to said cord mount.

10. The arrow rest system of claim 1 further comprising micro-adjustment means for aligning said launcher with said bow.

11. The arrow rest system of claim 1, wherein said launcher is in an upright position when said activator is in said second position, and wherein said launcher is in a lowered position when said activator is in said first position.

12. A fall away arrow rest system for use with a bow, said arrow rest comprising:

a housing adapted for attachment to said bow, said housing including a cavity having a wall with a first indentation and a notch defined at least partially within said first indentation;

a rotatable shaft including a first portion operably coupled to and supported by said housing and a second portion extending from said housing;

a launcher attached to said second portion of said shaft;

an activator disposed for a rotation within said cavity of said housing and coupled to said first portion of said shaft, wherein said rotation of said activator results in a rotation of said shaft and said launcher, said activator being moveable between a first position, a second position, and a third position within said housing, wherein said activator is disposed at a lowered position of rest at a first deflection angle at said first position, said activator is disposed at an upright supported position at a second deflection angle at said second position, and said activator is disposed at a fully drawn position at a third deflection angle at said third position, wherein the third deflection angle is greater than the second deflection angle;

wherein said activator comprises a stopping component that includes a depressible detent and a stop biasing element below said depressible detent, said stop biasing element applying an outward force to said depressible detent, wherein in said second position, said stopping component prevents said activator from rotating toward said first position by being received in said first indention and in engagement with a stop disposed on said wall adjacent to said notch; and a torsional biasing element operably connected to said housing at one end and to at least one of said shaft or said activator at a second end to apply a torque to said activator about a longitudinal axis of said shaft in a first rotational direction;

wherein in said third position, said activator may be released in one of a freely released condition or a let-down released condition, wherein in said let-down released condition, a shape of said stop, a shape of said depressible detent, a torque applied by said torsional biasing element at said second position, and a first momentum of said activator traveling through a radial displacement between said third position and said second position effectuates a second downward force on said depressible detent upon a collision of said depressible detent and said stop, wherein said first momentum includes a force applied by a user in opposition to said torque during said let-down released condition, and wherein said second downward force is less than said outward force so said depressible detent retains said activator at said second position during said let-down release condition.

13. The fall away arrow rest system of claim 12 wherein during said freely released condition, said shape of said stop, said shape of said depressible detent, said torque applied by said torsional biasing element at said second position, and a second momentum of said activator freely traveling through said radial displacement between said third position and said second position effectuate a third downward force on said depressible detent upon a collision of said depressible detent and said stop, wherein said third downward force is greater than said outward force to depress said depressible detent to clear said stop thereby allowing said torsional biasing element to rotate said activator to said first position.

* * * * *